US009273652B2

(12) United States Patent
Ito

(10) Patent No.: US 9,273,652 B2
(45) Date of Patent: Mar. 1, 2016

(54) AIR INTAKE DEVICE FOR INTERNAL COMBUSTION ENGINE

(75) Inventor: Atsushi Ito, Anjo (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 302 days.

(21) Appl. No.: 14/114,596

(22) PCT Filed: Jun. 12, 2012

(86) PCT No.: PCT/JP2012/065031

§ 371 (c)(1),
(2), (4) Date: Oct. 29, 2013

(87) PCT Pub. No.: WO2013/002020

PCT Pub. Date: Jan. 3, 2013

(65) Prior Publication Data

US 2014/0083399 A1 Mar. 27, 2014

(30) Foreign Application Priority Data

Jun. 28, 2011 (JP) ..... 2011-142915

(51) Int. Cl.
*F02M 35/104* (2006.01)
*F02M 35/10* (2006.01)

(52) U.S. Cl.
CPC ..... *F02M 35/104* (2013.01); *F02M 35/10222* (2013.01); *F02M 35/10268* (2013.01); *F02M 35/10321* (2013.01)

(58) Field of Classification Search
CPC ..... F02M 35/104; F02M 35/10222; F02M 35/10321; F02M 35/10268; F02M 35/10; F02M 25/07; F02M 25/0722; F02M 25/0723; F02M 35/10209; F02B 31/06
USPC ..... 701/108; 123/568.17, 568.18
See application file for complete search history.

(56) References Cited

U.S. PATENT DOCUMENTS 7,305,958 B2 12/2007 Doko et al.
8,181,633 B2 * 5/2012 Ito ..... F02B 31/06 123/568.17

(Continued)

FOREIGN PATENT DOCUMENTS

JP 2-115523 A 4/1990
JP 7-103082 A 4/1995

(Continued)

OTHER PUBLICATIONS

Notification of Transmittal of Translation of the International Preliminary Report on Patentability (Form PCT/IB/338 and PCT/IB/373) and the Written Opinion of the International Searching Authority (Form PCT/ISA/237) dated Jan. 16, 2014, issued in corresponding International Application No. PCT/JP2012/065031. (9 pgs).

(Continued)

*Primary Examiner* — Stephen K Cronin
*Assistant Examiner* — Xiao Mo
(74) *Attorney, Agent, or Firm* — Buchanan Ingersoll & Rooney PC

(57) ABSTRACT

Provided is an air intake device for an internal combustion engine, the air intake device being configured so that a reduction in the amount of intake air is minimized. An air intake device for an internal combustion engine has: an intake air path for supplying air from a surge tank to the combustion chamber of the internal combustion engine; and an exhaust gas path for supplying exhaust gas from an exhaust gas distribution header to the combustion chamber. The length of the exhaust gas path measured along the centerline of the exhaust gas path is set to be in the range from 75% to 125%, inclusive, of the length of the intake air path measured along the centerline of the intake air path.

7 Claims, 2 Drawing Sheets

(56) References Cited

U.S. PATENT DOCUMENTS

| | | | | |
|---|---|---|---|---|
| 2009/0223476 | A1 | 9/2009 | Shinkai et al. | |
| 2010/0077996 | A1 | 4/2010 | Pantow et al. | |
| 2011/0174279 | A1 * | 7/2011 | Ito | F02B 31/06 123/568.18 |

FOREIGN PATENT DOCUMENTS

| | | | | |
|---|---|---|---|---|
| JP | 2001-207918 | A | | 8/2001 |
| JP | 2004-0100707 | A | | 4/2004 |
| JP | 2004-270538 | A | | 9/2004 |
| JP | 2004270538 | A | * | 9/2004 |
| JP | 2006-97522 | A | | 4/2006 |
| JP | 2006-241992 | A | | 9/2006 |
| JP | 2009-008004 | A | | 1/2009 |
| JP | 2009-209855 | A | | 9/2009 |
| JP | 2009293556 | A | | 12/2009 |
| JP | 2010116870 | A | | 5/2010 |
| JP | 2010-521619 | A | | 6/2010 |
| JP | 2010-255599 | A | | 11/2010 |

OTHER PUBLICATIONS

Japanese Office Action (Notice of Reasons for Rejection) dated Oct. 16, 2014 issued in corresponding Japanese Patent Application No. 2011-142915 and an English translation of the Office Action.

International Search Report (PCT/ISA/210) mailed on Sep. 11, 2012, by the Japanese Patent Office as the International Searching Authority for International Application No. PCT/JP2012/065031.

Informal Comments filed in response to the International Search Report issued in International Application No. PCT/JP2012/065031.

Written Opinion (PCT/ISA/237) mailed on Sep. 11, 2013, by the Japanese Patent Office as the International Searching Authority for International Application No. PCT/JP2012/065031.

Office Action issued on Apr. 3, 2015, by the Japanese Patent Office in corresponding Japanese Patent Application No. 2011-142915, and an English Translation of the Office Action. (5 pages).

* cited by examiner

AIR INTAKE DEVICE FOR INTERNAL COMBUSTION ENGINE

TECHNICAL FIELD

The present invention relates to an air intake device for an internal combustion engine including an intake air path for supplying air from a surge tank to a combustion chamber of the internal combustion engine, and an exhaust gas path for supplying exhaust gas from an exhaust gas distribution header to the combustion chamber.

BACKGROUND ART

The air intake device for the internal combustion engine as described above includes the intake air path and the exhaust gas path in order to mix, for combustion in a combustion chamber, exhaust gas, blowby gas, or evaporated gas (evaporated gas of fuel) that is produced as wasted gas by driving the internal combustion engine, with combustion air.

Patent Document 1 listed below discloses a conventional air intake device for an internal combustion engine including a first exhaust gas path for supplying exhaust gas as waste gas from an EGR surge tank acting as the exhaust gas distribution header to the combustion chamber, a second exhaust gas path for supplying blowby gas as the waste gas from the interior of a cylinder head cover acting as the exhaust gas distribution header to the combustion chamber, and a third exhaust gas path for supplying evaporated gas as the waste gas from an unillustrated exhaust gas distribution header to the combustion chamber.

A downstream exhaust gas path section in each of the first to third exhaust gas paths and a downstream intake air path section of the intake air path constitute a common path.

An upstream exhaust gas path section of each of the first to third exhaust gas paths positioned upstream of the common path is provided desirably depending on a position of the EGR surge tank or the cylinder head cover.

In other words, no consideration is given to the relationship between the length of the exhaust gas path extending along the centerline of each of the exhaust gas paths and the length of the intake air path extending along the centerline of the intake air path. The length of each of the exhaust gas paths is set to a desirable value depending on the position of the EGR surge tank or the cylinder head cover.

PRIOR ART DOCUMENT

Patent Document

Patent Document 1: Japanese Unexamined Patent Application Publication No. 7-103082

SUMMARY OF INVENTION

Technical Problem

Therefore, an inertia supercharging effect may be marred to easily decrease the air intake to the combustion chamber, which may disadvantageously reduce the engine output.

More particularly, if air pulsation in the intake air path fails to coincide with gas pulsation in the exhaust gas path, pressure waves in the intake air path in which the air density is thick overlap pressure waves in the exhaust gas path in which the exhaust gas density is thin, thereby to easily lower the air intake pressure. As a result, the air intake is easily decreased.

The present invention has been made having regard to the above-described circumstances, and its object is to provide an air intake device for an internal combustion engine for properly maintaining the air intake to the combustion chamber.

Solution to Problem

A first aspect of an air intake device for an internal combustion engine according to the present invention lies in comprising an intake air path for supplying air from a surge tank to a combustion chamber of the internal combustion engine, and an exhaust gas path for supplying exhaust gas from an exhaust gas distribution header to the combustion chamber. The length of the exhaust gas path measured along the centerline of the exhaust gas path is set to be in the range from 75% to 125%, inclusive, of the length of the intake air path measured along the centerline of the intake air path.

According to the above-described arrangement for the an air intake device for the internal combustion engine, the length of the exhaust gas path measured along the centerline of the exhaust gas path is set to be in the range from 75% to 125%, inclusive, of the length of the intake air path measured along the centerline of the intake air path.

Therefore, the air pulsation in the intake air path tends to coincide with the gas pulsation in the exhaust gas path more easily, as a result of which the pressure waves in the intake air path in which the air density is thick easily overlap the pressure waves in the exhaust gas path in which the exhaust gas density is thick.

Consequently, the above arrangement allows the air intake to the combustion chamber to be properly maintained to suppress the decrease of the air intake.

A second aspect of the present invention lies in that the intake air path includes an upstream intake air path section and a downstream intake air path section. The exhaust gas path includes an upstream exhaust gas path section and a downstream exhaust gas path section. The downstream exhaust gas path section and the downstream intake air path section form a common path. The length of the exhaust gas path is the same as the length of the intake air path.

With the above-described arrangement, the exhaust gas and the combustion air are mixed in the common path to be supplied to the combustion chamber.

Further, the length of the exhaust gas path extending along the centerline of the exhaust gas path is the same as the length of the intake air path extending along the centerline of the intake air path.

Thus, the air pulsation in the intake air path can substantially coincide with the gas pulsation in the exhaust gas path.

Consequently, the above arrangement allows the air intake to the combustion chamber to be properly maintained to enhance the effect of suppressing the decrease of the air intake.

A third aspect of the present invention lies in that a ratio Lc/D of the length of the upstream exhaust gas path Lc measured along the centerline of the upstream exhaust gas path section to a path diameter D is set to 3 or greater.

With the above-described arrangement, since the ratio Lc/D of the length of the upstream exhaust gas path Lc to the path diameter D is set to 3 or greater, the flow of the exhaust gas merging from the upstream exhaust gas path section into the intake air path (common path) can be reliably formed, thereby to stabilize the flow of the mixture of the exhaust gas and the combustion air.

A fourth aspect of the present invention lies in that the upstream exhaust gas path section and the upstream intake air path section are arranged parallel with each other.

With the above-described arrangement, the length of the exhaust gas path can be easily set to a predetermined proportion of the length of the intake air path.

A fifth aspect of the present invention lies in that the upstream exhaust gas path section and the common path are connected to each other to allow the centerline of the upstream exhaust gas path section to cross the centerline of the intake air path with an angle smaller than 90 degrees.

With the above-described arrangement, the upstream exhaust gas path section can be easily connected to an intermediate portion of the intake air path to prevent the exhaust gas from flowing backward to the upstream intake air path section.

A sixth aspect of the present invention lies in that the upstream exhaust gas path section and the upstream intake air path section are sectioned by a common path wall to be arranged parallel with each other.

With the above-described arrangement, the upstream exhaust gas path section and the upstream intake air path section can be provided in a compact way.

Further, when the waste gas is the exhaust gas or blowby gas, it is possible to transmit the heat of the waste gas to the air present in the upstream intake air path section through the common path wall to preheat the combustion air.

A seventh aspect of the present invention lies in that the upstream exhaust gas path section communicates with an intermediate portion of the intake air path.

With the above-described arrangement, since the upstream exhaust gas path section is connected to the intake air path, the flow of the combustion air is reliably formed to stabilize the flow of the mixture of the exhaust gas and the combustion air.

A eighth aspect of the present invention lies in that the unit of the upstream exhaust gas path section and the exhaust gas distribution header comprises a body forming the exhaust gas path and a body forming the surge tank.

With the above-described arrangement, the upstream exhaust gas path section and the exhaust gas distribution header can be easily provided.

DESCRIPTION OF EMBODIMENTS

Embodiment of the present invention will be described hereinafter in reference to the accompanying drawings.

Figure 1:
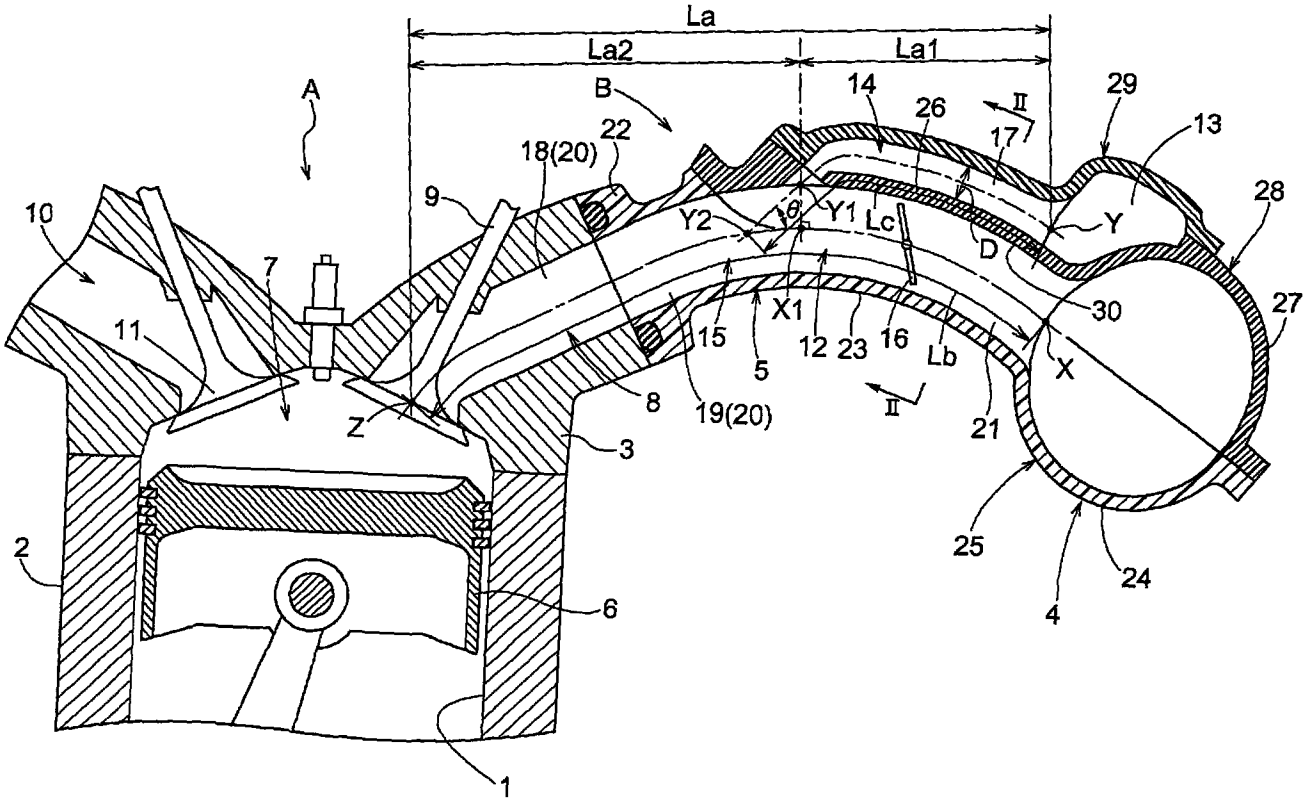
FIG. 1 is a vertical sectional view of an air intake device for an internal combustion engine.

FIG. 1 shows an air intake device B for an internal combustion engine according to the present invention, which is mounted in a gasoline engine A (an example of the internal combustion engine) including a plurality of cylinders 1.

The engine A includes a metal cylinder block 2 having the plurality of cylinders 1, and a metal cylinder head 3 connected to an upper portion of the cylinder block 2. The cylinder head 3 is connected to a resin intake manifold 5 communicating with a resin surge tank 4. A combustion chamber 7 is formed between the cylinder head 3 and a piston 6 housed in each of the cylinders 1.

Here, only a section corresponding to one of the cylinders 1 is illustrated in FIG. 1.

The cylinder head 3 includes a plurality of cylinder-side intake air paths 8 each communicating with the combustion chamber 7, a plurality of intake valves 9 for opening and closing outlets of the cylinder-side intake air paths 8, a plurality of exhaust gas paths 10 each communicating with the combustion chamber 7, and a plurality of exhaust valves 11 for opening and closing inlets of the exhaust gas paths 10.

The air intake device B for the internal combustion engine includes a plurality of intake air paths 12 each having a circular section over the length from the surge tank 4 to the combustion chamber 7 for distributing and supplying air from the surge tank 4 to the combustion chamber 7 through the intake manifold 5, and a plurality of exhaust gas paths 14 each having a circular section over the length from an exhaust gas distribution header (EGR chamber) 13 to the combustion chamber 7 for distributing and supplying exhaust gas produced by driving the engine A from the exhaust gas distribution header 13 to the combustion chamber 7.

The intake manifold 5 is provided with a plurality of intake manifold-side intake air paths 15 (referred to as "manifold-side intake air paths" hereinafter) communicating with the cylinder-side intake air paths 8, and air flow control valves (butterfly valves) 16 provided in the manifold-side intake air paths 15.

Thus, the air intake device B for the internal combustion engine includes the intake air paths 12 continued from the manifold-side intake air paths 15 and the cylinder-side intake air paths 8.

Each of the exhaust gas paths 14 has an upstream exhaust gas path section 17 communicating with, from above, an intermediate portion of the corresponding manifold-side intake air path 15 positioned downstream of the air flow control valve 16, and a downstream exhaust gas path section 18 located downstream of the upstream path section to allow the upstream exhaust gas path section 17 to communicate with the intermediate portion of the corresponding intake air path 12.

Hence, a common path 20 is constituted by the downstream exhaust gas path section 18 and a downstream intake air path section 19 of the intake air path 12 positioned downstream of the portion communicating with the upstream exhaust gas path section 17.

Further, while the upstream exhaust gas path section 17 is formed with a section of the exhaust gas path 14 positioned upstream of the common path 20, an upstream intake air path section 21 is formed with a section of the intake air path 12 positioned upstream of the common path 20.

The unit of the intake manifold 5 and the surge tank 4 includes a resin lower body 25 and a resin upper body 28 that are joined together by vibration welding, for example. The lower body 25 is an integral unit combining a flange 22 connected to the cylinder head 3, a half lower intake air path wall section 23, and a half lower surge tank wall section 24. The upper body 28 is an integral unit combining a half upper intake air path wall section 26 and a half upper surge tank wall section 27.

A resin exhaust gas forming body 29 is joined to a top surface of the upper body 28 by vibration welding, for example. The upstream exhaust gas path section 17 and the exhaust gas distribution header 13 are defined between the upper body 28 and the exhaust gas path forming body 29.

Figure 2:
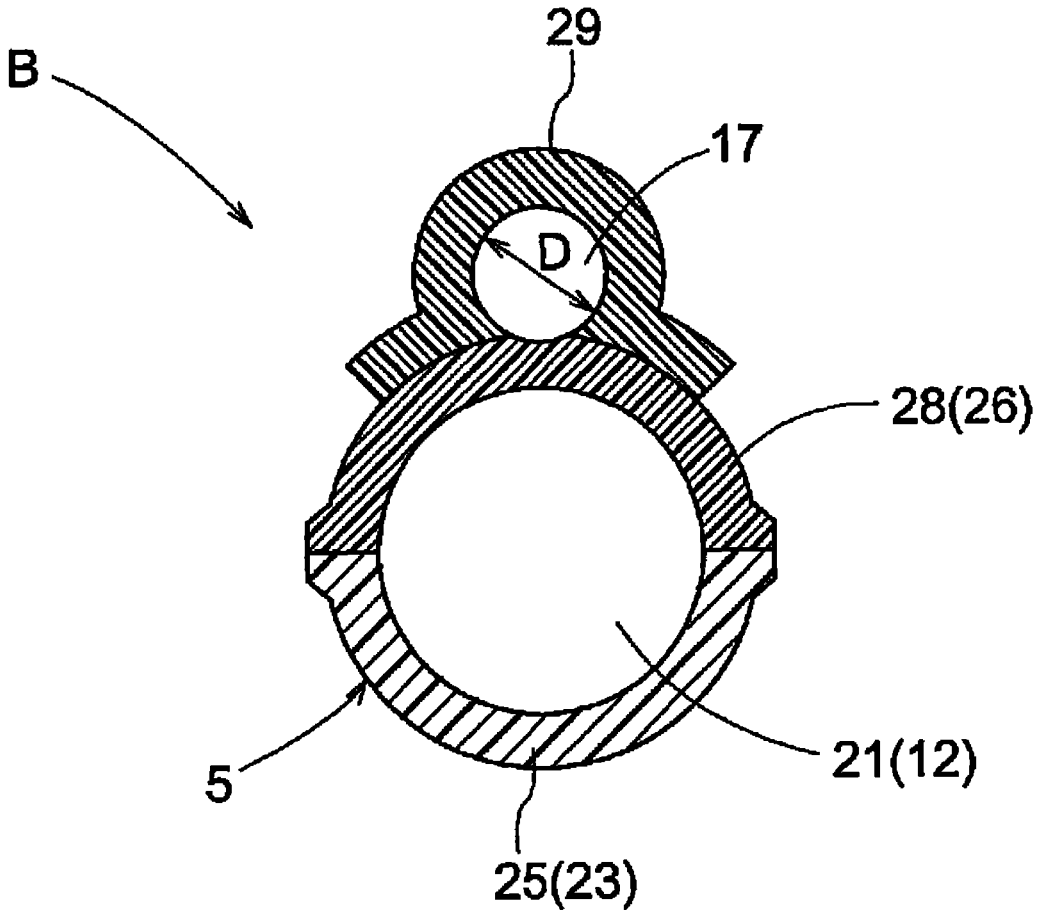
FIG. 2 is a sectional view taken on line II-II of FIG. 1.

Therefore, as shown in FIG. 2, the upstream exhaust gas path section 17 having a circular section and the upstream intake air path section 21 having a circular section are sectioned by a common path wall 30 formed with the upper body 28 to be arranged parallel with each other, for example.

The upstream exhaust gas path section 17 and the common path 20 are connected to each other so that a centerline (Y-Y2) of the upstream exhaust gas path section 17 crosses a centerline (X-Z) of the intake air path 12 with an angle θ smaller than 90 degrees.

X represents a center of the intake air path 12 in a boundary between the surge tank 4 and the upstream intake air path section 21, which acts as a starting point as the intake air path 12.

Z represents a center of the intake air path 12 in a boundary between the combustion chamber 7 and the downstream intake air path section 19, which acts as a terminal point of the intake air path 12.

On the other hand, Y acting as a starting point of the exhaust gas path 14 represents a center of the exhaust gas path 14 in a boundary between the exhaust gas distribution header 13 and the upstream exhaust gas path section 17. A terminal point of the exhaust gas path 14 is Z, which also acts as the terminal point of the intake air path 12.

Y2 is a section where an extension of the centerline of the upstream exhaust gas path section 17 intersects the centerline (X-Z) of the intake air path 12.

Referring to FIG. 1, a length of the exhaust gas path La (a total length of a length La1 measured along Y-Y1 and a length La2 measured along X1-Z) measured along the centerlines (Y-Y1 and X1-Z) of the exhaust gas path 14 is set to be in the range from 75% to 125%, inclusive, of a length of the intake air path Lb measured along the centerline (X-Z) of the intake air path 12. More particularly, in the current embodiment, the length of the exhaust gas path La is set to substantially the same (100%) as the length of the intake air path Lb (420 mm).

Y1 represents a section where the centerline of the upstream exhaust gas path section 17 intersects an outlet opening of the upstream exhaust gas path section 17 leading to the intake air path 12.

X1 represents a section where a line segment passing through Y1 intersects the centerline (X-Z) of the intake air path 12 at right angles.

Further, as shown in FIG. 1, a ratio of a length Lc of the upstream exhaust gas path measured along the centerline (Y-Y1) of the upstream exhaust gas path section 17 and the extension thereof (Y1-Y2) to a path diameter D (Lc/D) is set to 3 or greater. More particularly, in the current embodiment, the ratio Lc/D is set to approximately 44 (Lc=310 mm, D=7 mm).

MODIFICATIONS

1. According to the air intake device for the internal combustion engine of the present invention, the intake air path and the exhaust gas path may be provided separately from each other over the length.

2. The air intake device for the internal combustion engine of the present invention may include an exhaust gas path for supplying blowby gas functioning as the waste gas to the combustion chamber.

3. The air intake device for the internal combustion engine of the present invention may include an exhaust gas path for supplying evaporated gas functioning as the waste gas to the combustion chamber.

4. According to the air intake device for the internal combustion engine of the present invention, the upstream exhaust gas path section may be independently formed with a separate pipe that is different form the pipe forming the upstream intake air path section.

5. The air intake device for the internal combustion engine of the present invention may be provided in a rotary engine, in addition to a reciprocating engine such as a gasoline engine and a diesel engine.

REFERENCE SIGNS LIST

4 surge tank
7 combustion engine
12 intake air path
13 exhaust gas distribution header
14 exhaust gas path
17 upstream exhaust gas path section
18 downstream exhaust gas path section
19 downstream intake air path section
20 common path
21 upstream intake air path section
30 common path wall
A internal combustion engine
D path diameter
La length of the exhaust gas path
Lb length of the intake air path
Lc length of the upstream exhaust gas path
X-Z centerline of the intake air path
Y-Y1, X1-Z centerline of the exhaust gas path
Y-Y1 centerline of the upstream exhaust gas path
θ angle

The invention claimed is:

1. An air intake device for an internal combustion engine, comprising:

an intake air path for supplying air from a surge tank to a combustion chamber of the internal combustion engine; and an exhaust gas path for supplying exhaust gas from an exhaust gas distribution header to the combustion chamber, wherein the length of the exhaust gas path measured along the centerline of the exhaust gas path is set to be in the range from 75% to 125%, inclusive, of the length of the intake air path measured along the centerline of the intake air path, the intake air path includes an upstream intake air path section and a downstream intake air path section, the exhaust gas path includes an upstream exhaust gas path section and a downstream exhaust gas path section, the downstream exhaust gas path section and the downstream intake air path section form a common path, the upstream exhaust gas path section and the upstream intake air path section of the intake air path positioned upstream of the common path are arranged parallel with each other, the surge tank comprises a lower body and an upper body, the lower body being an integral unit combining a half lower intake air path wall section and a half lower surge tank wall section, the upper body being an integral unit combining a half upper intake air path wall section and a half upper surge tank wall section, and the upstream exhaust gas path section and the exhaust gas distribution header are formed on a top surface of the upper body.

2. The air intake device according to claim 1, wherein the length of the exhaust gas path is the same as the length of the intake air path.

3. The air intake device according to claim 2, wherein a ratio Lc/D of the length of the upstream exhaust gas path Lc measured along the centerline of the upstream exhaust gas path section to a path diameter D is set to 3 or greater.

4. The air intake device according to claim 2, wherein the upstream exhaust gas path section and the common path are connected to each other to allow the centerline of the upstream exhaust gas path section to cross the centerline of the intake air path with an angle smaller than 90 degrees.

5. The air intake device according to claim 1, wherein the upstream exhaust gas path section and the upstream intake air path section are sectioned by a common path wall to be arranged parallel with each other.

6. The air intake device according to claim 2, wherein the upstream exhaust gas path section communicates with an intermediate portion of the intake air path.

7. The air intake device according claim 2, wherein the unit of the upstream exhaust gas path section and the exhaust gas distribution header comprises a body forming the exhaust gas path and a body forming the surge tank.

* * * * *